US010487572B2

(12) United States Patent
Smith et al.

(10) Patent No.: US 10,487,572 B2
(45) Date of Patent: Nov. 26, 2019

(54) PIVOTABLE HANDLE FOR AN ARCHITECTURAL COVERING

(71) Applicant: Hunter Douglas Inc., Pearl River, NY (US)

(72) Inventors: Stephen P. Smith, Denver, CO (US); Michael True, Thornton, CO (US); Galen B. Rhodes, Henderson, CO (US); Tim Daviau, Broomfield, CO (US); Kent Smith, Broomfield, CO (US); Paula Cerna, Broomfield, CA (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 15/414,801

(22) Filed: Jan. 25, 2017

(65) Prior Publication Data

US 2017/0211322 A1 Jul. 27, 2017

Related U.S. Application Data

(60) Provisional application No. 62/286,894, filed on Jan. 25, 2016.

(51) Int. Cl.

| | |
|---|---|
| ***E06B 9/322*** | (2006.01) |
| ***E06B 9/262*** | (2006.01) |
| *E06B 9/24* | (2006.01) |

(52) U.S. Cl.

CPC ..... *E06B 9/322* (2013.01); *E06B 9/262* (2013.01); *E06B 2009/2435* (2013.01); *E06B 2009/2627* (2013.01)

(58) Field of Classification Search

CPC .... E06B 9/262; E06B 9/2627; E06B 9/17046; E06B 9/388; E06B 2009/2435; E06B 9/78; E06B 9/42; E06B 9/322

USPC .... 16/114.1, 408, 409, 410, 110.1, 419, 420

See application file for complete search history.

(56) References Cited

U.S. PATENT DOCUMENTS

| | | | | |
|---|---|---|---|---|
| 1,892,087 A | | 12/1932 | Stuber | |
| 2,624,906 A | | 1/1953 | Foster | |
| 2,715,243 A | * | 8/1955 | Koll | E05B 1/0015 116/DIG. 12 |
| 2,767,424 A | * | 10/1956 | Knuepfer | A45C 13/26 116/DIG. 12 |
| 2,865,044 A | | 12/1958 | Bielek | |

(Continued)

FOREIGN PATENT DOCUMENTS

| | | | | |
|---|---|---|---|---|
| AU | 201614398 | | 10/2016 | |
| EP | 1353037 | A2 | 10/2003 | |
| WO | WO-2013129919 | A1 * | 9/2013 | E06B 9/388 |

*Primary Examiner* — Katherine W Mitchell
*Assistant Examiner* — Jeremy C Ramsey
(74) *Attorney, Agent, or Firm* — Hoffman Warnick LLC

(57) ABSTRACT

A pivotable handle for an architectural covering is provided. The handle may include first and second members pivotably connected together at a hinge assembly. The first member may be operable to connect the handle to a movable rail. The second member may pivot between stored and use positions. In a stored position, the second member may extend adjacent the first member. In a use position, the second member may be pivoted away from the first member to extend the movable rail across an architectural structure. The handle may include a biasing member operable to bias the second member towards the first member.

20 Claims, 6 Drawing Sheets

(56) References Cited

U.S. PATENT DOCUMENTS

| | | | | |
|---|---|---|---|---|
| 3,470,764 | A | 10/1969 | Frymire | |
| 3,581,798 | A | 1/1971 | Malamed | |
| 3,692,155 | A | 9/1972 | Laurita | |
| 4,687,041 | A | 8/1987 | Anderson | |
| 4,831,678 | A | 5/1989 | Dietsche | |
| 4,884,615 | A | 12/1989 | Hsu | |
| 4,911,348 | A | 3/1990 | Rasor et al. | |
| 5,265,307 | A | 11/1993 | Hull et al. | |
| 5,937,929 | A | 8/1999 | Chen | |
| 6,536,503 | B1 | 3/2003 | Anderson et al. | |
| 7,175,377 | B2 | 2/2007 | Womack | |
| 7,389,565 | B2 | 6/2008 | Cheng | |
| 7,451,525 | B2 * | 11/2008 | Willems | A45C 13/26 16/408 |
| 7,802,608 | B2 | 9/2010 | Anderson et al. | |
| D647,777 | S | 11/2011 | Franssen | |
| 2002/0157796 | A1 | 10/2002 | Judkins | |
| 2002/0174961 | A1 | 11/2002 | Anderson et al. | |
| 2004/0131439 | A1 | 7/2004 | Womack et al. | |
| 2007/0084567 | A1 | 4/2007 | Chen | |
| 2008/0115894 | A1 | 5/2008 | Cech et al. | |
| 2009/0106942 | A1 | 4/2009 | Dell'Orfano | |
| 2012/0097349 | A1 | 4/2012 | Chen | |
| 2012/0227912 | A1 | 9/2012 | Anderson et al. | |
| 2012/0267056 | A1 | 10/2012 | Ko | |
| 2014/0076504 | A1 | 3/2014 | Anthony et al. | |
| 2014/0216666 | A1 | 8/2014 | Smith et al. | |
| 2015/0013921 | A1 | 1/2015 | Franssen | |
| 2015/0020982 | A1 | 1/2015 | Anderson et al. | |
| 2015/0034262 | A1 | 2/2015 | Franssen | |
| 2015/0197984 | A1 | 7/2015 | Anderson et al. | |
| 2015/0259978 | A1 | 9/2015 | Lin et al. | |
| 2016/0010389 | A1 | 1/2016 | Anderson et al. | |

* cited by examiner

PIVOTABLE HANDLE FOR AN ARCHITECTURAL COVERING

CROSS REFERENCE TO RELATED APPLICATIONS

This application claims the benefit of priority under 35 USC § 119(e) of the earlier filing date of U.S. Provisional Patent Application No. 62/286,894 filed 25 Jan. 2016 and entitled "Pivotable Handle for an Architectural Covering," which is hereby incorporated by reference in its entirety.

TECHNICAL FIELD

This present disclosure relates generally to architectural coverings, and more specifically to a pivotable handle for an architectural covering.

BACKGROUND

Architectural coverings, such as coverings for structures, including walls and openings, such as windows, doorways, archways, and the like, have taken numerous forms for many years. Some coverings include a retractable shade material that is movable between an extended position and a retracted position. A movable rail typically is attached to an edge of the shade material to facilitate extension of the shade material across an architectural structure/feature and to maintain the shade material in a desired configuration. Some movable rails include a handle that facilitates a user moving the movable rail across the architectural structure/feature. Use of some handles may result in a user touching the shade material during extension of the movable rail across the architectural structure/feature.

BRIEF SUMMARY

The present disclosure generally provides a pivotable handle for an architectural covering that offers improvements or an alternative to existing arrangements. The handle may be coupled to a movable rail to move the movable rail across an architectural structure. In a preferred embodiment, the handle includes a handle member pivotable between use and stored positions. In a use position, the handle member may permit a user to extend the movable rail across an architectural structure by engaging an element spaced apart from the main body of the movable rail. The handle member may be biased to a stored position in which the handle member extends adjacent the movable rail.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The accompanying drawings, which are incorporated into and constitute a part of the specification, illustrate embodiments of the present disclosure by way of illustration only and, together with the general description above and the detailed description below, serve to explain the principles of the present disclosure.

DETAILED DESCRIPTION

In accordance with various principles of the present disclosure, a handle is coupled to an architectural covering to provide one or more enhanced methods of extending or retracting the covering across an architectural structure. In one embodiment, the handle is coupled to a portion of the covering, such as a movable rail, in a manner that permits operation of the covering via the handle, such as by a user applying force via the handle to a part of the covering spaced apart from the shade material, which may be attached to the movable rail. The handle may be associated with a cordless covering in some contexts. In such embodiments, the cordless covering may be operated by a user manipulating the handle to move the movable rail. The user may manipulate the handle to move the rail without touching a shade material (such as a fabric) coupled with the rail, thereby not damaging the aesthetics of the shade material. The handle may conform to the configuration of the element to which it is coupled, such as the movable rail, to provide a desired aesthetic and/or functional characteristic, such as providing a clean or streamlined appearance when coupled to the covering. The handle may be coupled with the movable rail between front and rear edges of the rail. The handle may be positionable anywhere along a length of the rail. The handle may include a pivotable handle member that swings away from the movable rail, and the handle member may be biased towards the movable rail to provide a smooth, "clean," or streamlined appearance when not in use.

Figures 3, 4:
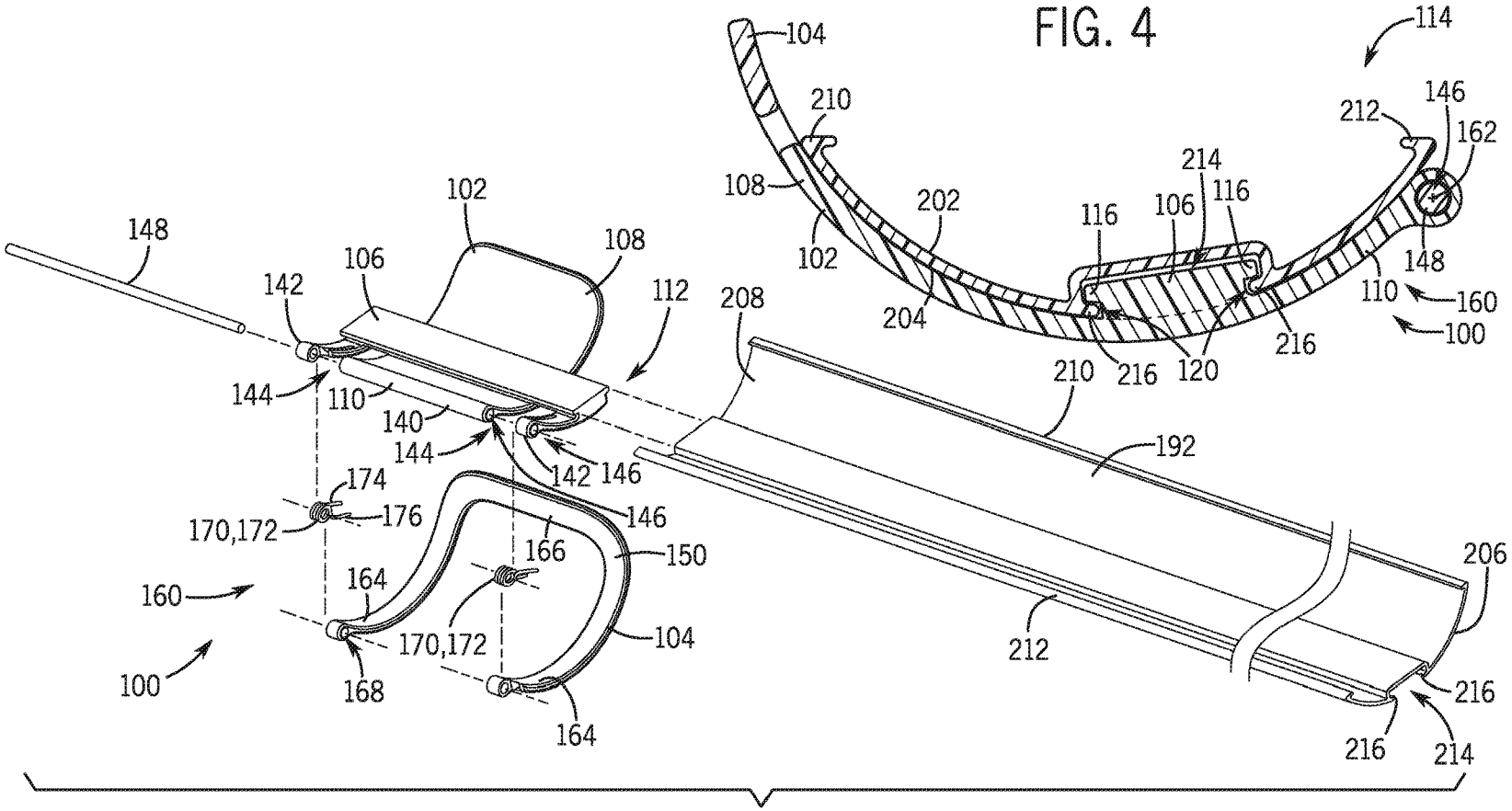
FIG. 3 is a fragmentary, exploded view of the covering of FIG. 1 in accordance with an embodiment of the present disclosure.
FIG. 4 is an enlarged, cross-sectional view of a handle assembly taken along line A-A of FIG. 1 in accordance with an embodiment of the present disclosure.
Figure 5:
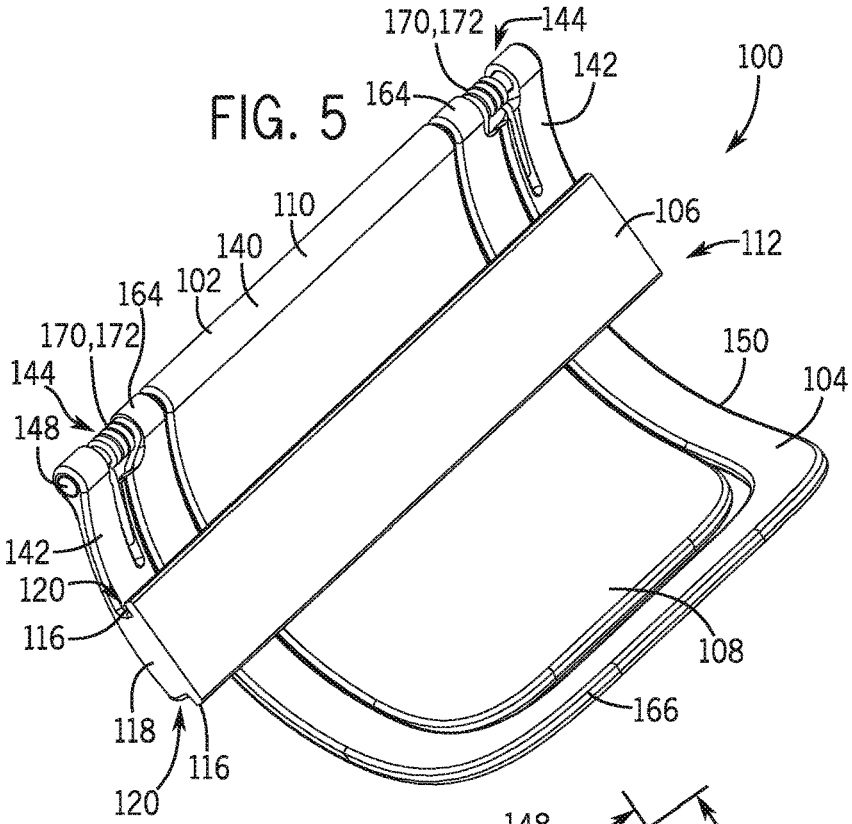
FIG. 5 is a top isometric view of a handle assembly in accordance with an embodiment of the present disclosure.
Figure 6:
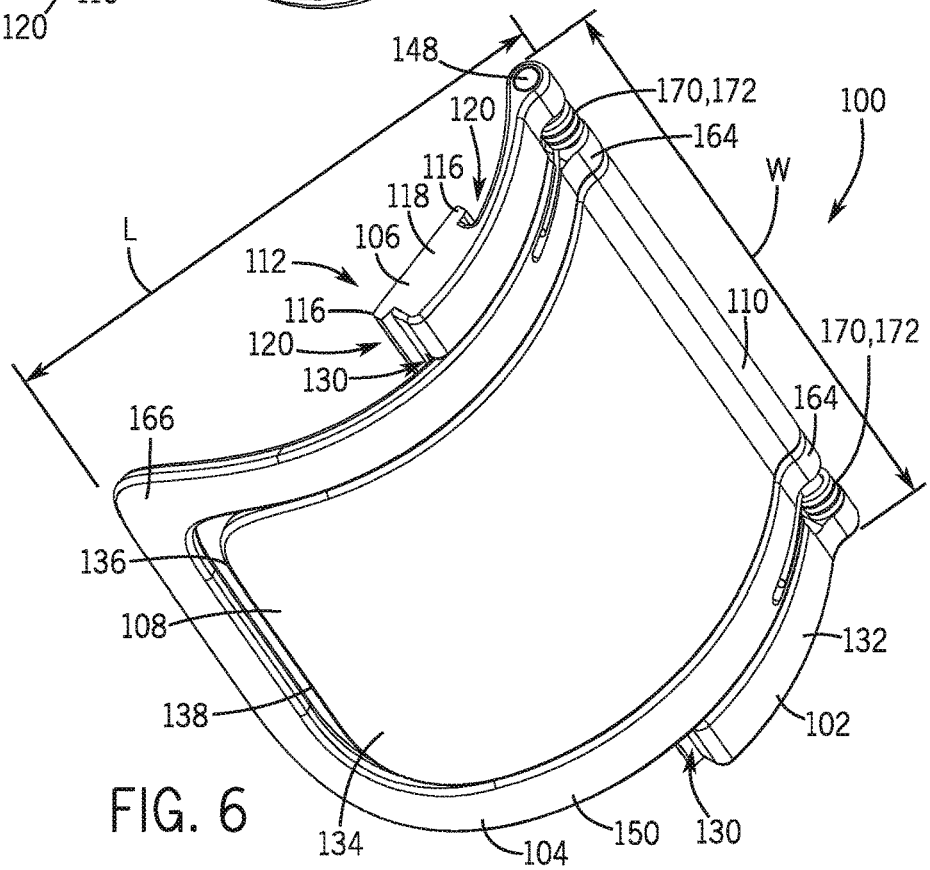
FIG. 6 is a bottom isometric view of the handle assembly of FIG. 5 in accordance with an embodiment of the present disclosure.

Referring to FIGS. 3-9, a handle assembly 100 according to one embodiment of the present disclosure includes first and second members 102, 104 connected together to collectively define a length L (see FIG. 6), a transverse width W (see FIG. 6), and a thickness T (see FIG. 9) of the handle assembly 100 such that the handle assembly 100 may be considered wide and thin. The first member 102, which may be referred to as a base member, a fixed member, or any combination thereof, may include an attachment portion 106 and opposing front and rear portions 108, 110 extending laterally from opposing sides of the attachment portion 106. In one embodiment, the attachment portion 106 may extend substantially along the width W of the handle assembly 100, with the front and rear portions 108, 110 extending laterally therefrom substantially along the length L (see FIG. 6). As more fully explained below, the attachment portion 106 may include attachment structure 112 operable to couple, for instance, the first member 102 to an associated covering 114 for an architectural structure, such as a window, doorway, archway, or the like (see FIGS. 1 and 2), to permit a user to operate the covering 114. For example without limitation, with reference to FIGS. 5 and 6, the attachment structure 112 may include opposing tabs 116 extending laterally from a central portion 118 of the attachment portion 106. The tabs 116 may extend longitudinally along the length of the attachment portion 106 or, in some embodiments, may be intermittently connected to the central portion 118. In such embodiments, the attachment portion 106 may be substantially T-shaped in cross-section to facilitate attachment of the first member 102 to the covering 114, as detailed below. In one embodiment, the front and rear portions 108, 110 of the first member 102 may extend from the attachment portion 106 at a spaced distance below the opposing tabs 116. In this manner, opposing grooves 120 may be defined between the opposing tabs 116 and the respective front and rear portions 108, 110 for connection with the covering 114, as explained more fully below (see FIG. 9). As best seen in FIG. 6, a plurality of channels 130 may be defined in an exterior surface (e.g., a bottom surface 132) of the attachment portion 106. The channels 130 may extend transversely to the attachment portion 106, such as substantially along the length L of the handle assembly 100.

With continued reference to FIG. 6, the front portion 108 of the first member 102 may define a touch point or gripping feature 134 for a user and may be curvilinear in shape. For example, the front portion 108 may be defined in part by a front edge 136 extending (e.g., looping) from the attachment portion 106. The front edge 136 may be curved such that a middle portion 138 of the front edge 136 is spaced furthest from the attachment portion 106. As illustrated, the front edge 136 may extend from the attachment portion 106 at a distance spaced away (inward) from the periphery of the attachment portion 106 defining the width W of the handle assembly 100. In this manner, the front portion 108 may include a width $W_{FP}$ that is smaller than the width W of the handle assembly 100 such that the second member 104 may be positioned within the width W of the handle assembly 100, as explained in detail below (see FIG. 7). As illustrated, the front edge 136 may extend from the attachment portion 106 at a substantially transverse angle, though other extension angles, such as less than 90 degrees or greater than 90 degrees, are contemplated without departing from the spirit and scope of the present disclosure.

Figure 7:
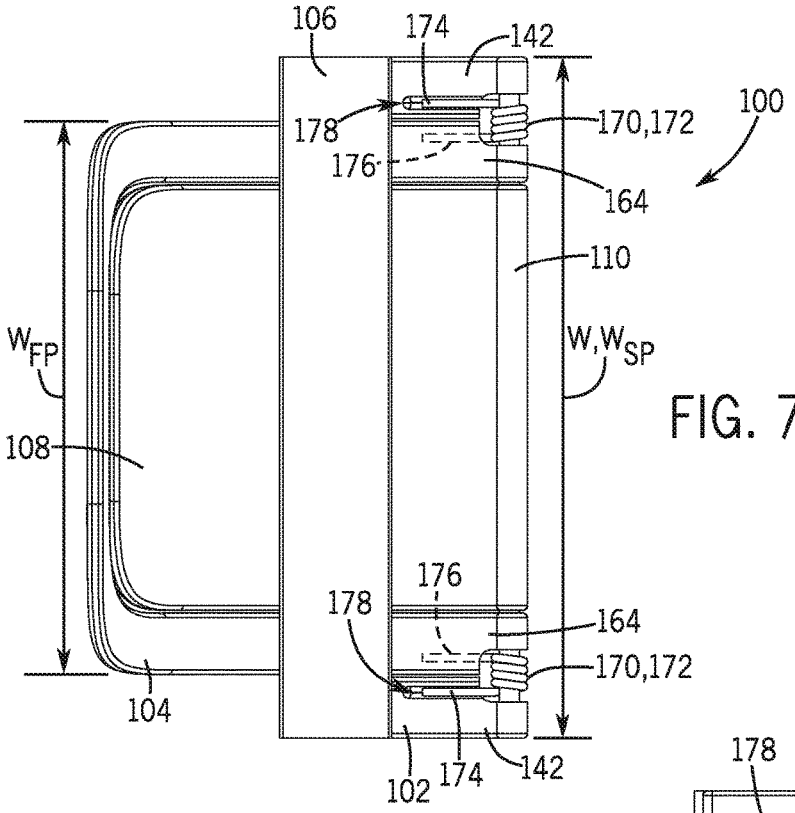
FIG. 7 is a top view of the handle assembly of FIG. 5 in accordance with an embodiment of the present disclosure.
Figure 8:
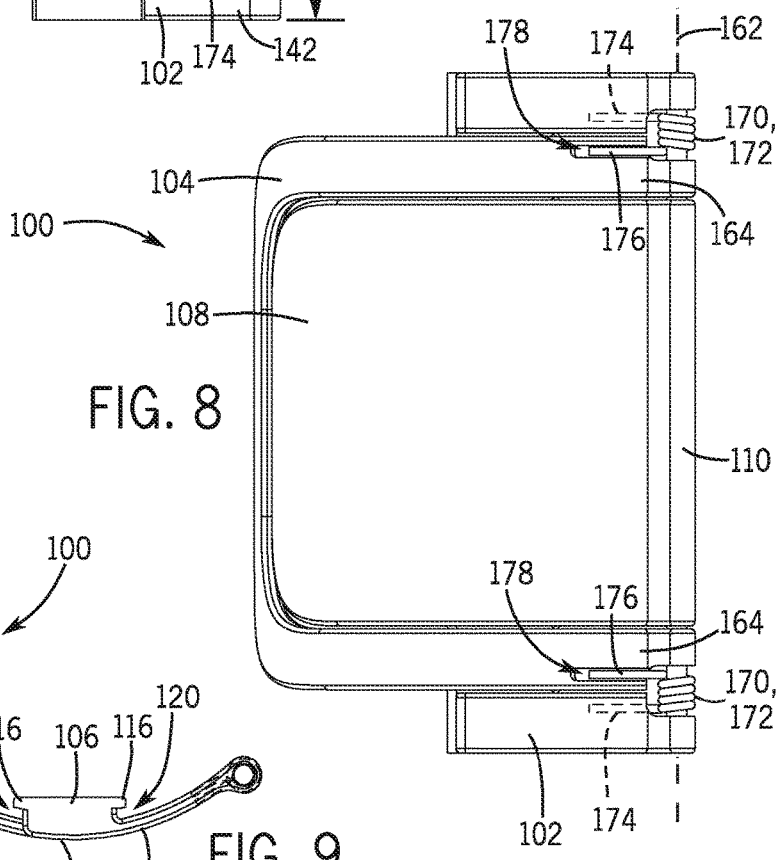
FIG. 8 is a bottom view of the handle assembly of FIG. 5 in accordance with an embodiment of the present disclosure.
Figure 9:
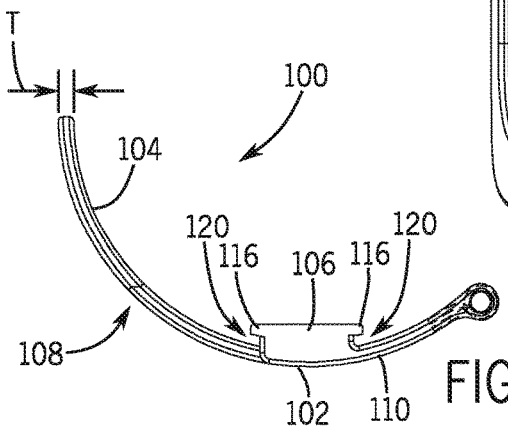
FIG. 9 is a side elevation view of the handle assembly of FIG. 5 in accordance with an embodiment of the present disclosure.

The first member 102 may be arranged to permit the second member 104 to pivot relative to the first member 102. In one embodiment, illustrated in FIG. 5, the rear portion 110 of the first member 102 may be defined by a center portion 140 and at least one side portion 142 positioned on each side of the center portion 140. In one embodiment, each side portion 142 may be spaced laterally from the center portion 140 to define openings 144 therebetween. As explained below, the openings 144 may be sized and shaped to receive at least a portion of the second member 104 therein. As shown in FIG. 7, the side portions 142 may be positioned outboard the front portion 108 along the width W of the handle assembly 100 such that a width $W_{SP}$ defined between the side portions 142 may be greater than the width $W_{FP}$ of the front portion 108. In some embodiments, the rear portion 110 may include structure operable to couple the first and second members 102, 104 together. For example, as best seen in FIG. 3, in one embodiment, the rear portion 110 may define at least one bore 146 to facilitate coupling of the second member 104 to the first member 102, as explained below. As illustrated, aligned bores 146 may be defined in the center portion 140 and the side portions 142 for the purposes explained hereinafter. Though shown and described as including a center portion 140 and at least one side portion 142, the first member 102 may include any suitable configuration operable to pivotably couple the first member 102 to the second member 104. For example without limitation, the first member 102 may be configured such that the second member 104 is completely outside the first member 102, or vice-versa.

With reference to FIG. 4, the front and rear portions 108, 110 of the first member 102 may be sized and shaped to achieve a desired aesthetic and/or functional characteristic. In some embodiments, the front and rear portions 108, 110 may follow the contour and/or shape of a portion of the covering 114 to which it is attached. For example, the front portion 108 and/or the rear portion 110 may be curved in transverse cross-section to create a smooth, clean, or non-obtrusive transition between the front portion 108 and/or the rear portion 110 of the handle assembly 100 and the associated covering 114. Additionally or alternatively, depending on the particular application, the front and rear portions 108, 110 may be smooth to provide a desired aesthetic characteristic and/or increase a user's comfort in grasping the first member 102 specifically or the handle assembly 100 in general.

Referring now to FIGS. 5 and 6, the second member 104 may be attached or otherwise coupled to the rear portion 110 of the first member 102. In some embodiments, the second member 104, which may be referred to as a handle member or a movable member, may be rotatably coupled to the first member 102 by an elongate shaft 148. In such embodiments, the second member 104 may include a handle portion 150 extending from the shaft 148. The shaft 148 may be cylindrical and may include a circular or non-circular cross-section. As best seen in FIGS. 3 and 4, the shaft 148 is sized and shaped for rotatable receipt within at least one bore 146 defined in the rear portion 110 of the first member 102. Together, the shaft 148 and bore 146 define a hinge assembly 160 by which the second member 104 may be pivoted relative the first member 102 about a hinge centerline 162 and between stored and use positions, as explained hereafter. For example, in a stored position, the second member 104 may be positioned adjacent the first member 102 such that the second member 104 is substantially flush with the first member 102 (see FIG. 10). In a use position, the second member 104 may be pivoted away from the first member 102 such that the first and second members 102, 104 extend at an angle relative to each other (see FIG. 11).

Referring now to FIG. 3, the handle portion 150 may be substantially U-shaped and may include terminal end portions 164 and a grip portion or touch point 166 positioned therebetween. In some embodiments, the touch point 166 may be an additional member connected to the handle portion 150. The shaft 148 may be connected to the terminal end portions 164. For instance, the terminal end portions 164 may define bores 168 therethrough through which the shaft 148 may be inserted. In some embodiments, the shaft 148 may be formed monolithically with the terminal end portions 164 as one integral piece. Referring to FIG. 5, when the second member 104 is coupled to the first member 102, such as via rotatable receipt of the shaft 148 within the bore(s) 146 of the rear portion 110, the terminal end portions 164 may be received within the openings 144 defined between the center and side portions 140, 142 of the first member 102. Additionally or alternatively, at least a portion of the second member 104 (e.g., the terminal end portions 164 and/or the touch point 166) may be received within the channels 130 defined in the bottom surface 132 of the attachment portion 106 at least when the second member 104 is in a stored position (see FIG. 6). As illustrated, the touch point 166 may compliment the size and shape of the first member 102. For example, the touch point 166 may be sized and shaped to closely match the curved nature of the front edge 136 of the front portion 108 to provide a smooth or clean interface or transition between the first and second members 102, 104, for instance. Additionally or alternatively, the touch point 166 may conform to the configuration of the element to which it is coupled, such as a movable rail, to provide a desired aesthetic and/or functional characteristic, such as providing a clean or streamlined appearance when coupled to the covering 114.

Referring now to FIGS. 5-8, the handle assembly 100 may include a biasing member 170 operable to bias the second member 104 to a desired position relative to the first member 102. For example, the biasing member 170 may provide a biasing force directing the second member 104 towards the first member 102. In some embodiments, the biasing force may be variable to provide an increasing amount of biasing effect with distance of the second member 104 away from the first member 102. The biasing force may be sufficient to maintain the second member 104 adjacent the first member 102 (e.g., in abutting relationship) under static conditions, such as by sufficiently counteracting the effect of gravity tending to rotate the second member 104 away from the first member 102. The biasing member 170 may be positioned at least partially between the first and second members 102, 104 and may bias the second member 104 to the stored position. In one embodiment, the biasing member 170 may be a spring 172 (e.g., a helical torsion spring) having first and second ends 174, 176 engaged with the first and second members 102, 104, respectively (see FIGS. 7 and 8). For example, each of the first and second members 102, 104 may define spring seats 178 therein operable to engage a corresponding first end 174 or second end 176 of the spring 172. The spring seat 178 of the first member 102 may be defined in at least one of the side portions 142, and the spring seat 178 of the second member 104 may be defined in at least one of the terminal end portions 164. The spring seats 178 may be operable to twist, bend, extend, compress, or otherwise increase or decrease the spring force of the spring 172 during rotation of the second member 104 relative to the first member 102. In embodiments wherein the spring 172 is a helical torsion spring, the spring 172 may be rotatably mounted to the shaft 148 and may be positioned at least partially in the openings 144. Though described herein with reference to a spring 172, the biasing member 170 may be a torsion bar, a magnetic assembly, or any other suitable biasing mechanism.

With reference to FIGS. 1-4, the handle assembly 100 may be coupled to a portion of the covering 114 to facilitate movement of the covering 114 between extended and retracted positions covering or uncovering the architectural structure. For purposes of illustration, the covering 114 may substantially take the form of the shade disclosed in U.S. Publication No. 2014/0216666 A1 to Smith et al, which is hereby incorporated herein in its entirety. In one embodiment, the covering 114 may include a head rail 190, a movable rail 192 to which the handle assembly 100 is attached, and a shade material 194 extending between the head rail 190 and the movable rail 192. Movement of the covering 114 may be controlled by an operating system 196, such as the operating system disclosed in U.S. Publication No. 2014/0216666 A1. The shade material 194 may be substantially any type of shade, such as the shade material disclosed in U.S. Publication No. 2014/0216666 A1, and may include operable vanes 198 movable between open (see FIG. 1) and closed (see FIG. 2) orientations. To move the vanes 198 between open and closed orientations, the covering 114 may include a vane orientation mechanism 200, such as the vane orientation mechanism disclosed in U.S. Publication No. 2014/0216666 A1.

The handle assembly 100 may be coupled with movable rail 192 between front and rear edges of the rail 192 and may conform to the shape and/or dimensions of an outer surface of the rail 192. The coupling of the handle assembly 100 to the rail 192 may allow positioning of the handle assembly 100 anywhere along the movable rail 192. In one embodiment, illustrated in FIGS. 3 and 4, the movable rail 192, which may be a bottom rail or a top rail, among others, may be an elongate member with a generally low aspect ratio of height to depth such that the movable rail 192 may be considered long, thin, and deep. For example, in some embodiments, the movable rail 192 may include an aspect ratio of height to depth between about 1:2 and about 1:5 (e.g., about 1:3.5). As illustrated, the movable rail 192 includes a top surface 202 and a bottom surface 204. The movable rail 192 includes opposing left and right side edges 206, 208 and opposing front and rear longitudinal edges 210, 212 together forming a perimeter of the movable rail 192. To couple the handle assembly 100 to the movable rail 192, the movable rail 192 may include a longitudinal channel 214 defined in a portion (e.g., the bottom surface 204) of the movable rail 192. In some embodiments, the channel 214 may be positioned nearer one of the front and rear longitudinal edges 210, 212 (e.g., nearer the rear longitudinal edge 212), though the channel 214 may be positioned substantially midway between the front and rear longitudinal edges 210, 212 depending on the particular application. The channel 214 may be sized and shaped to allow coupling of the attachment portion 106 therein. In this manner, the handle assembly 100 may be at least partially received within the channel 214 to couple the handle assembly 100 to the movable rail 192. For example, opposing flanges 216 may extend within the channel 214 along a length (e.g., the entire length) of the movable rail 192 between the left and right side edges 206, 208. As best seen in FIG. 4, the flanges 216 may extend inwardly towards each other and may be sized and shaped for receipt within the grooves 120 defined in the attachment portion 106. In such embodiments, the outwardly extending tabs 116 of the handle assembly 100 and the inwardly extending flanges 216 of the movable rail 192 may be complementary hooks engaging each other.

Figure 1:
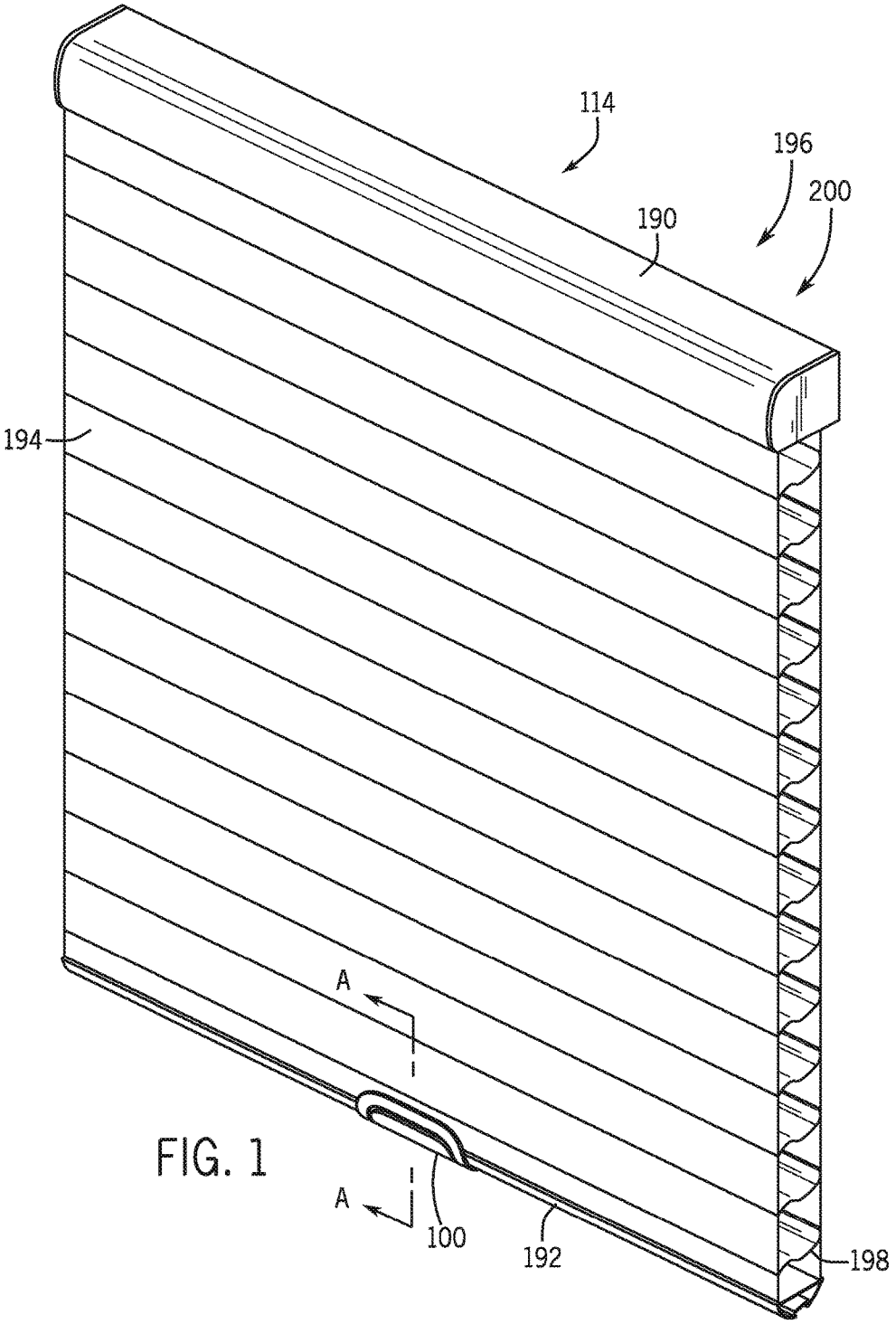
FIG. 1 is a front isometric view of a covering in an open configuration in accordance with an embodiment of the present disclosure.
Figure 2:
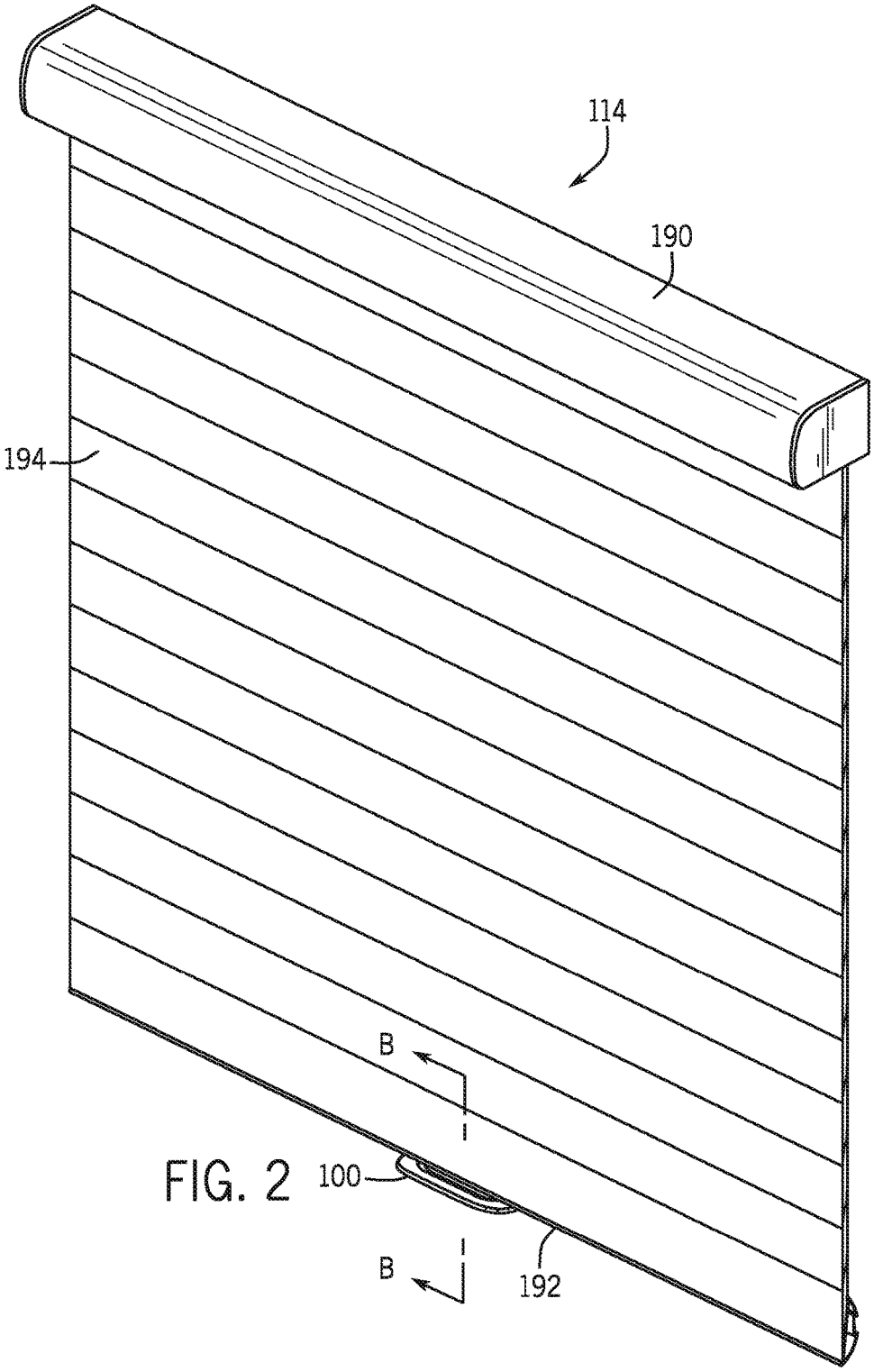
FIG. 2 is a front isometric view of the covering of FIG. 1 in a closed configuration in accordance with an embodiment of the present disclosure.

Referring to FIG. 3, to couple the handle assembly 100 to the movable rail 192, the handle assembly 100 may be positioned adjacent the movable rail 192 so the attachment portion 106 is in alignment with the channel 214. The attachment portion 106 of the handle assembly 100 may then be slid into the channel 214 from one end (e.g., the right side edge 208) towards the opposite end (e.g., the left side edge 206) of the movable rail 192. Once connected to the movable rail 192, the attachment portion 106 may be slid within the channel 214 to position the handle assembly 100 at substantially any desired location between the left and right side edges 206, 208 of the movable rail 192. Depending on the particular application, the engagement between the handle assembly 100 and the movable rail 192 may limit lateral movement of the handle assembly 100 relative to the movable rail 192. For example without limitation, the attachment portion 106 of the handle assembly 100 and/or the channel 214 of the movable rail 192 may be sized and shaped such that attachment portion 106 is interference fit within the channel 214. Once the handle assembly 100 is coupled to the movable rail 192, the front portion 108 of the first member 102 may be adjacent, and in some embodiments may extend beyond, the front longitudinal edge 210 of the movable rail 192. As shown in FIG. 1, the second member 104 may extend beyond the front longitudinal edge 210 of the movable rail 192, though it is contemplated the second member 104 may be positioned within the perimeter of the movable rail 192 to achieve a desired aesthetic characteristic in some embodiments. Additionally or alternatively, in one embodiment, the rear portion 110 of the first member 102 may be adjacent the rear longitudinal edge 212 of the movable rail 192 (see FIG. 4). In such embodiments, the hinge centerline 162 may be positioned adjacent the rear longitudinal edge 212 of the movable rail 192 between the rear longitudinal edge 212 and the channel 214. Though shown adjacent the rear longitudinal edge 212 of the movable rail 192, the hinge centerline 162 may be positioned substantially anywhere between the front and rear longitudinal edges 210, 212 to provide a desired point load or force distribution on the movable rail 192. For example without limitation, the hinge centerline 162 may be positioned to provide a substantially uniform force distribution on the movable rail 192.

Figure 10:
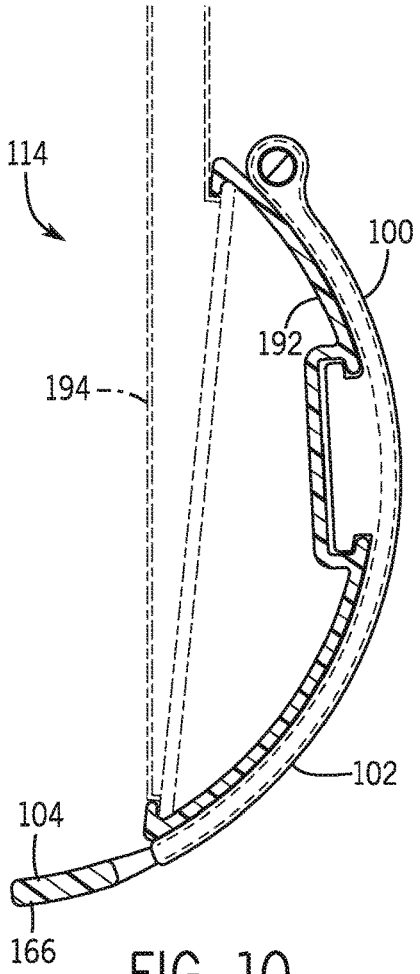
FIG. 10 is an enlarged, cross-sectional view of the covering of FIG. 2 taken along line B-B of FIG. 2 in accordance with an embodiment of the present disclosure.
Figure 11:
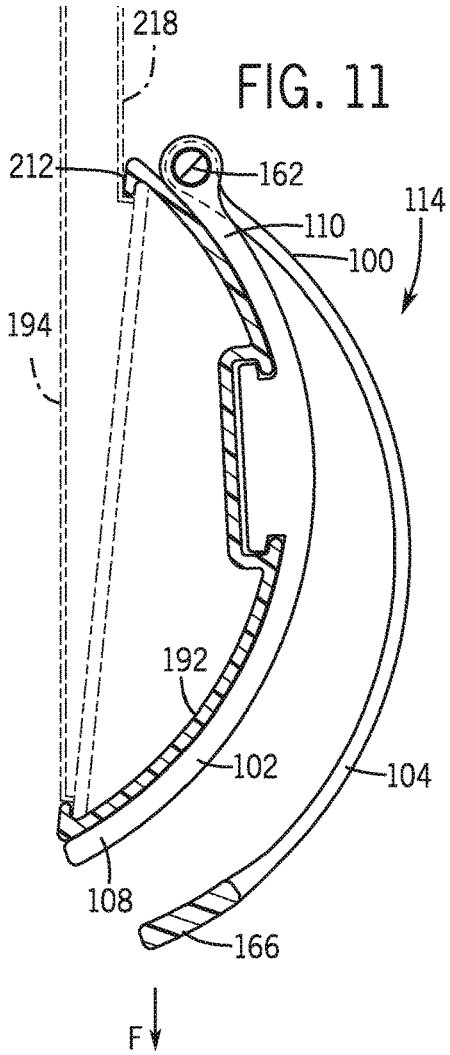
FIG. 11 is an additional enlarged, cross-sectional view of the covering of FIG. 2 taken along line B-B of FIG. 2 in accordance with an embodiment of the present disclosure.
Figure 12:
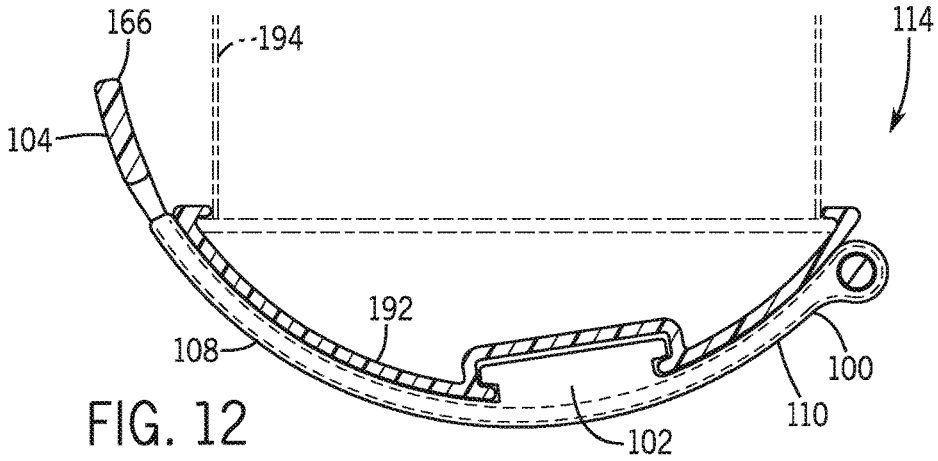
FIG. 12 is an additional enlarged, cross-sectional view of the covering of FIG. 1 taken along line A-A of FIG. 1 in accordance with an embodiment of the present disclosure.

With reference to FIGS. 10-12, a user may actuate the handle assembly 100 to move the movable rail 192 across an architectural structure to cause the covering 114 to transition between extended and retracted positions and/or to cause the vanes 198 to transition between open and closed orientations. Referring to FIG. 11, to extend the covering 114 across the architectural structure, a user may grasp the second member 104, such as at handle portion 150 and optionally at touch point 166 if provided, to rotate the second member 104 away from the first member 102 in a first rotational direction (e.g., counter-clockwise in FIG. 11). As the second member 104 (e.g., the touch point 166) rotates away from the first member 102 (e.g., from the front portion 108), potential energy is stored in the biasing member 170 tending to bias the second member 104 to rotate in a second rotational direction (e.g., clockwise in FIG. 11) opposite the first rotational direction. Using the second member 104, a user may then extend the covering 114 across the architectural structure to a desired position such as by manipulating (e.g., pulling) the handle portion 150, and optionally the touch point 166 if provided, to move the movable rail 192 in a first direction (e.g., downwards in FIG. 11) away from the head rail 190. In this manner, a user may extend the movable rail 192 across the architectural structure. Because the hinge centerline 162 may be positioned adjacent the rear longitudinal edge 212 of the movable rail 192, an extension force F provided by the user to the second member 104 may be directed to a rear portion (e.g., a rear sheet 218) of the shade material 194, which may be desirable depending on the particular shade material 194, such as to move the vanes 198 from the closed orientation to the open orientation by pulling on the rear sheet 218 when the shade material 194 is fully extended. Once in a desired position, the user may release the second member 104 at which point the second member 104 may rotate automatically towards the first member 102 to its stored position (see FIG. 10). As explained in U.S. Publication No. 2014/0216666 A1, the operating system 196 may apply a counterbalancing force to support the shade material 194 at any level of extension selected by the user. In some embodiments, the movable rail 192 may be manipulated to move the vanes 198 between open and closed orientations. For instance, to open the vanes 198, a user may rotate the movable rail 192 in the second rotational direction to operate the vane orientation mechanism 200. For example, the user may grasp the front and/or rear portions 108, 110 of the first member 102 to rotate the movable rail 192 to move the shade material 194 between open and closed positions.

Retracting the covering 114, if desired, may be accomplished in substantially reverse order as described above, thus allowing a user to select whether to have the shade material 194 in a fully extended position, a fully retracted position, or any position in between. For example, to retract the covering 114, the user may first rotate the movable rail 192 in the first rotational direction such as through manipulation of the front and/or rear portions 108, 110 of the first member 102. In such embodiments, rotation of the movable rail 192 in the first rotational direction may operate the vane orientation mechanism 200 to close the vanes 198. The user may then lift the movable rail 192, such as by the handle assembly 100, towards the head rail 190 to a desired position providing a desired level of retraction. As noted above, the counterbalancing force applied by the operating system 196 may support the shade material 194 at any level of retraction selected by the user.

The handle assembly 100 and the movable rail 192 may be constructed of substantially any type of material. For example, the handle assembly 100 and the movable rail 192 may be constructed or formed from natural and/or synthetic materials, including metals, ceramics, plastics, vinyl, and/or other suitable materials. Plastic materials may include thermoplastic material (self-reinforced or fiber-reinforced), ABS, polycarbonate, polypropylene, polystyrene, PVC, polyamide, or PTFE, among others. In some embodiments, the movable rail 192 may be formed of extruded aluminum or another thermoformable material. The handle assembly 100 may be built, formed, molded, or non-molded in any suitable manner, such as by plug molding, blow molding, injection molding, milling or the like.

The foregoing description has broad application. It should be appreciated that the concepts disclosed herein may apply to many types of shades, in addition to the shades described and depicted herein. Similarly, it should be appreciated that the concepts disclosed herein may apply to many types of rails, in addition to the movable rail 192 described and depicted herein. For example, the concepts may apply equally to any type of rail movable through a handle assembly. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A handle assembly for an architectural covering, said handle assembly comprising:

a first member including opposing front and rear portions, and including a coupling mechanism shaped and configured to mechanically engage with a bottom exterior surface of a moveable rail of the architectural covering;

a second member including opposing front and rear portions and pivotably attached to said rear portion of said first member at a hinge assembly located rearward of the coupling mechanism, such that said rear portion of said second member is coupled to a rear portion of the moveable rail through said rear portion of said first member, said second member pivotable between a stored position in which said front portion of said second member is positioned forward of and extends adjacent to said front portion of said first member and a front portion of the moveable rail in a direction away from the hinge assembly along said bottom exterior surface of the moveable rail, and a use position in which said second member is pivoted away from said front portion of said first member, wherein said second member is coupled to the moveable rail through said first member to permit a downward force thereon to downwardly move the moveable rail; and a biasing member operable to bias said second member to said stored position.

2. The handle assembly of claim 1, wherein: said handle assembly includes a shaft;

said second member includes a handle portion extending from said shaft; and said shaft is received at least partially within a bore defined in said rear portion of said first member to define said hinge assembly.

3. The handle assembly of claim 2, wherein said handle portion of said second member is substantially U-shaped and substantially surrounds a periphery of said front portion of said first member in said stored position.

4. The handle assembly of claim 2, wherein said biasing member is a torsion spring engaged with said first and second members.

5. The handle assembly of claim 1, wherein in said stored position said second member is substantially flush and coplanar with said first member.

6. The handle assembly of claim 1, wherein said biasing member is positioned at least partially between said first and second members.

7. The handle assembly of claim 1, wherein said first member includes an attachment portion positioned between said front and rear portions, said attachment portion extending transversely away from a major plane in which said second member extends.

8. The handle assembly of claim 1, wherein:

said first member includes an exterior surface and a plurality of grooves defined in said exterior surface;

said second member is at least partially received in said plurality of grooves in said stored position; and said first member visually obscures said second member in said plurality of grooves in said stored position.

9. The handle assembly of claim 1, wherein:

said second member includes a touch point; and said touch point is positioned on an opposite side of said handle assembly relative to said hinge assembly.

10. The handle assembly of claim 1, wherein said second member is substantially U-shaped to define a cavity, and wherein said first member is received at least partially within said cavity of said second member.

11. The handle assembly of claim 1, wherein said second member in said stored position is substantially coplanar with said first member, and wherein said rear portion of said second member is substantially vertically aligned with said rear portion of said first member.

12. The handle assembly of claim 1, wherein the coupling mechanism fixes the first member against movement with respect to the moveable rail.

13. The handle assembly of claim 1, wherein said first member, said second member, and said biasing member are external to said moveable rail.

14. An architectural covering comprising:

a shade material;

a movable rail including opposing front and rear portions and attached to said shade material and wherein said moveable rail includes a groove extending along a longitudinal length of a bottom exterior surface of said movable rail; and a handle assembly at least partially received within said groove between said front portion and said rear portion of said moveable rail, said handle assembly including:

a first member including opposing front and rear portions;

a second member pivotably attached to said first member at a hinge assembly located rearward of said groove, said second member including a rear portion coupled to said rear portion of said moveable rail through said rear portion of said first member, and a front portion located forward of said front portion of said first member and said moveable rail in a direction away from the hinge assembly, said second member being operationally independent of said moveable rail of said window shading and pivotable between a stored position in which said second member extends adjacent said front portion of said first member and said front portion of said second member is located forward of said first member, and a use position in which said second member is pivoted away from said front portion of said first member; and a biasing member operable to bias said second member towards said first member.

15. The covering of claim 14, wherein said first member includes an attachment structure operable to couple said first member to said movable rail, wherein the attachment structure is non-coplanar with the first member.

16. The covering of claim 14, wherein said first member includes an attachment portion received within said groove of said movable rail.

17. The covering of claim 16, wherein said attachment portion and said movable rail define complementary hooks to secure said handle assembly to said movable rail.

18. The covering of claim 14, wherein:

said movable rail includes opposing front and rear longitudinal edges;

said first member includes opposing front and rear portions;

said front portion extends adjacent said front longitudinal edge; and said rear portion extends adjacent said rear longitudinal edge.

19. The covering of claim 14, wherein said hinge assembly includes a hinge centerline positioned adjacent a rear edge of said movable rail.

20. The covering of claim 14, wherein said moveable rail visually obscures said handle assembly when said second member is in said stored position.

* * * * *